United States Patent [19]

Chapman et al.

[11] Patent Number: 4,569,243

[45] Date of Patent: Feb. 11, 1986

[54] LINEAR NO-BACK DEVICE

[75] Inventors: John R. Chapman; Gary D. Gillingham, both of Rockford, Ill.

[73] Assignee: Sundstrand Corporation, Rockford, Ill.

[21] Appl. No.: 725,820

[22] Filed: Apr. 22, 1985

Related U.S. Application Data

[63] Continuation of Ser. No. 540,419, Oct. 11, 1983, abandoned.

[51] Int. Cl.[4] ..... G05G 5/18

[52] U.S. Cl. ..... 74/470; 74/582

[58] Field of Search ..... 74/470, 582

[56] References Cited

U.S. PATENT DOCUMENTS

| | | | |
|---|---|---|---|
| 823,095 | 6/1906 | Anderson | 74/582 X |
| 937,481 | 10/1909 | Smith | 74/582 X |
| 1,990,978 | 2/1935 | Child | 244/29 |
| 2,186,653 | 1/1940 | Penote | 74/470 |
| 2,295,731 | 9/1942 | Groves | 74/503 |
| 2,647,412 | 8/1953 | Warmoes et al. | 74/470 |
| 2,959,982 | 11/1960 | Cadwallader | 74/531 |
| 3,206,999 | 9/1965 | Roth | 74/470 X |
| 3,575,565 | 4/1971 | Silvius | 74/470 X |
| 4,087,970 | 5/1978 | Slazar et al. | 74/470 X |
| 4,238,975 | 12/1980 | Jones | 74/470 X |
| 4,290,318 | 9/1981 | Ookubo et al. | 74/470 X |
| 4,325,266 | 4/1982 | Lynch | 74/470 X |
| 4,523,490 | 6/1985 | Dixon | 74/470 X |

*Primary Examiner*—William E. Tapolcai

*Attorney, Agent, or Firm*—Wood, Dalton, Phillips, Mason & Rowe

[57] ABSTRACT

A linear no-back device for transmitting bi-directional linear motion from an input shaft to an output shaft while preventing motion of the output shaft independently of the input shaft and enabling movement of the input shaft when the output shaft is jammed. The linear no-back device has a fixed member having a bore with a pair of spring discs loosely mounted on the output shaft and having flexible ears at the periphery thereof in engagement with a wall of the bore. A pair of spaced-apart stop rings on the output shaft limit separating movement of the spring discs axially of the output shaft and a preloaded compression coil spring urges the spring discs away from each other. Actuating members associated with the input shaft are effective upon movement of the input shaft in either linear direction to effectively disengage the spring discs from the wall of the bore and transmit motion of the input shaft to the output shaft through a motion-transmitting connection including the preloaded compression coil spring. Further compression of the preloaded compression coil spring enables movement of the input shaft relative to the output shaft when the latter is jammed.

8 Claims, 3 Drawing Figures

LINEAR NO-BACK DEVICE

This is a continuation of application Ser. No. 540,419 filed Oct. 11, 1983, now abandoned.

TECHNICAL FIELD

This invention pertains to a linear no-back device wherein bi-directional linear motion of an input shaft can be transmitted to a coaxial output shaft while preventing motion of the output shaft independently of the input shaft. The device permits linear motion of the input shaft if the output shaft is jammed and unable to move. One use of the linear no-back device is in a control linkage system having more than one input. A condition could occur where one input would back-drive the other, negating the required input stroke and the linear no-back device functions to prevent back-driving at one of the inputs.

BACKGROUND ART

Various types of linear no-back devices having an input shaft and an output shaft are known in the prior art; however, none of these devices enable movement of the input shaft if the output shaft is unable to move.

DISCLOSURE OF THE INVENTION

A primary feature of the invention is to provide a linear no-back device for transferring linear motion from an input shaft to a coaxial output shaft while preventing motion of the output shaft independently of the input shaft and which permits movement of the input shaft if the output shaft should be prevented from moving.

Another feature of the invention is to provide a linear no-back device of a new and improved construction having a pair of oppositely-acting conical spring discs which function to lock an output shaft against movement in either direction, means operable by an input shaft to release the active conical spring disc preparatory to movement of the output shaft in one direction, and a motion-transmitting connection between the input shaft and the output shaft including a preloaded compression coil spring which permits movement of the input shaft if the output shaft cannot move.

An object of the invention is to provide a linear no-back device for transmitting bi-directional linear motion from an input shaft to an output shaft while preventing motion of the output shaft independently of the input shaft comprising, a fixed member having a bore, a pair of oppositely-acting spring discs loosely mounted on the output shaft and having peripheral flexible means in engagement with a wall of said bore, a pair of spaced-apart stop means on the output shaft for limiting separating movement of said spring discs axially of the output shaft, means urging said spring discs away from each other including a pair of members engageable one with each of said spring discs and a preloaded compression coil spring therebetween, and means movable with the input shaft for effectively disengaging said spring discs from said wall and acting on one of said members to transmit motion to the output shaft through said compression coil spring, the other of said members and one of said stop means.

BEST MODE FOR CARRYING OUT THE INVENTION

Figure 1:
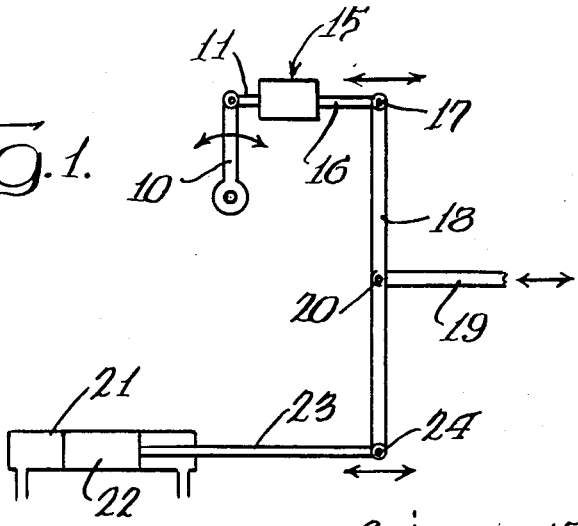
FIG. 1 is a schematic of a control linkage system.

A control linkage system of a type that could use the linear no-back device disclosed herein is shown in FIG. 1. An input member, shown in the form of a manually-operable crank 10, is operatively connected to an input shaft 11 of a linear no-back device, indicated generally at 15. This device has an output shaft 16 which is pivotally connected at 17 to one end of a walking beam 18. The control output is applied to a link 19 which is pivotally connected at 20 to the walking beam 18 intermediate its ends.

Another input, for example, could be provided by a hydraulic servo comprising cylinder 21 having a piston 22 which has a rod 23 extending to a pivot connection 24 at an end of the walking beam. With an input at the input shaft 11 and with the piston rod 23 momentarily held against movement, the link 19 is caused to move to effect an operation. When the piston rod 23 is moved to operate the link 19, the output shaft 16 is held against movement by the linear no-back device 15.

Figure 2:
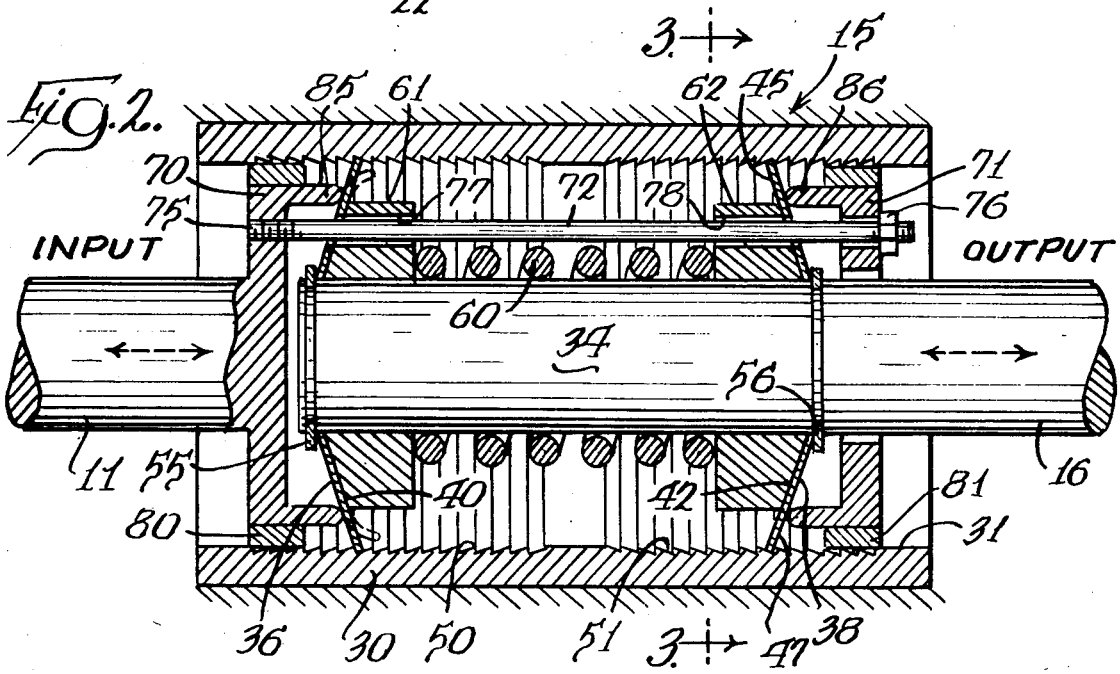
FIG. 2 is a central vertical longitudinal section of the linear no-back device.
Figure 3:
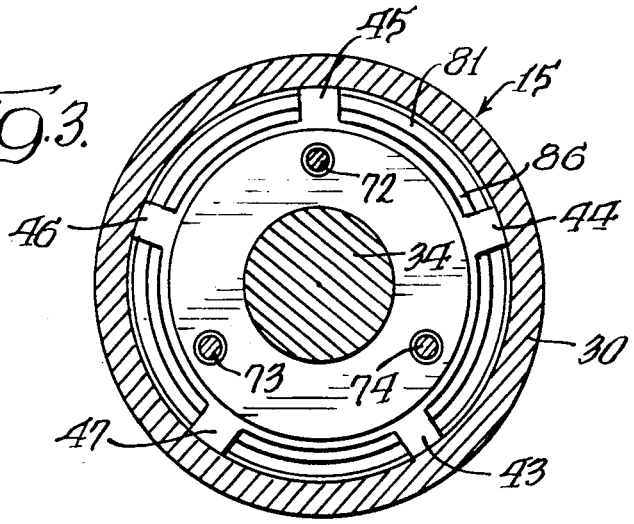
FIG. 3 is a vertical section, taken generally along the line 3—3 in FIG. 2.

The linear no-back device 15 is shown more particularly in FIGS. 2 and 3. The device has a fixed member 30, in the form of a cylinder having an internal bore with a wall 31. As seen in FIG. 2, the input shaft 11 and the output shaft 16 are in coaxial relation with a part 34 of the output shaft being located within the bore of the fixed member 30.

The means for releasably locking the output shaft 16 against movement comprises a pair of oppositely-acting conical spring discs 36 and 38 which are loosely mounted on the output shaft part 34. Each of these conical spring discs 36 and 38 is of the same construction with a solid body and a concave inner face, with the respective concave inner faces 40 and 42 being in facing relation.

The conical spring discs, which may be of spring steel, have a peripheral flexible means in the form of a plurality of flexible ears which extend outwardly to engage the wall 31 of the fixed member. The conical spring disc 38 has the flexible ears 43–47 and the conical spring disc 36 has the same arrangement of flexible ears. With the conical spring discs positioned as shown in FIG. 2, it will be seen that the flexible ears are at an angle to the wall 31 and thus act to prevent movement of a conical spring disc in one direction only. More particularly, the conical spring disc 36 is free to move to the left in FIG. 2, while the angle of the flexible ears precludes movement to the right. The conical spring disc 38 is free to move to the right, while the angle of the flexible ears precludes movement to the left. The wall 31 may be serrated. However, in a preferred embodiment, there are oppositely-angled ratchet teeth 50 and 51 providing moderately sloped surfaces for a purpose more fully described hereinafter.

The conical spring discs 36 and 38 are urged in a separating direction axially of the output shaft by means to be described and are limited in their separating movement by stop means in the form of a pair of stop rings 55 and 56 inserted in grooves in the output shaft part 34. The conical spring discs are urged against the stop means by structure including a preloaded compression coil spring 60 surrounding the output shaft part 34 and engaging at opposite ends against a pair of circular blocks 61 and 62 loosely mounted on the output shaft 16 and which have conical faces engaging the concave inner faces 40 and 42 of the conical spring discs 36 and 38 radially inwardly of the flexible ears 43–47.

Means associated with the input shaft 11 provide for release of the locking action of the active conical spring disc and for transmission of motion through a motion-transmitting connection to the output shaft 16. This means includes a pair of actuator members 70 and 71 in the form of rings, with the actuator member 70 being shown as integral with the input shaft 11 and the actuator member 71 being connected to the input shaft 11 through the actuator member 70 by a plurality of rods 72–74. The connection of each of the rods is the same, with the connection of rod 72 being shown particularly in FIG. 2.

One end of the rod is threaded into the actuator member 70, as shown at 75. The opposite end of the rod passes through an opening in the actuator member 71 and has a nut 76 threaded thereto. Intermediate its ends, the rod 72 passes through openings 77 and 78 in the circular blocks 61 and 62. The actuator members 70 and 71 are slidably mounted within the bore of the fixed member 30 and each can have suitable bearing material in the form of an annular ring 80 and 81, respectively, secured to the outer periphery thereof.

The actuator member 70 has an annular protrusion 85 with a rounded end which lies closely adjacent a convex face of the conical spring disc 36 and in a radial direction lies substantially beyond the perimeter of the circular block 61 whereby movement of the input shaft 11 to the right, as viewed in FIG. 2, will deflect the flexible ears of the conical spring disc 36 to the broken line position, shown in FIG. 2, to release the conical spring disc from locking relation with the fixed member. The actuating member 71 has a similar annular protrusion 86 positioned to act in the same manner with respect to the conical spring disc 38.

The linear no-back device operates as follows. With the parts as shown in full line in FIG. 2, the output shaft 16 is locked against axial movement in either direction. Movement toward the left, as seen in the Figure, is blocked by the conical spring disc 38 engaging directly against the stop ring 56 and with flexible ears 43–47 engaging ratchet teeth 51. Movement toward the right is blocked by the conical spring disc 36 acting directly on the stop ring 55 and with the flexible ears engaging ratchet teeth 50.

Linear movement of the input shaft 11 toward the right, as viewed in FIG. 2, causes the annular protrusion 85 of the actuator member 70 to flex the flexible ears of the conical spring disc 36 to the broken line position shown. Continued movement of the input shaft 11 toward the right effects movement of the output shaft 16 toward the right through a motion-transmitting connection comprising the conical spring disc 36, the circular block 61, the preloaded compression coil spring 60, the circular block 62, the conical spring disc 38, and the stop ring 56. During this movement, the flexible ears 43–47 of the conical spring disc 38 will ratchet along the ratchet teeth 51. Also during this movement, the actuator member 71 will be moved to the right through its engagement with the conical spring disc 38. Upon termination of movement of the input shaft 11 toward the right, the conical spring disc 38 will operate to prevent movement of the output shaft 16 toward the left, as viewed in the Figure.

A similar action occurs when the input shaft 11 is moved toward the left in FIG. 2, with the actuator member 71 being effective through the rods 72–74. The annular protrusion 86 of the actuator member 71 deflects the ears 43–47 of the conical spring disc 38 and motion is transmitted to the output shaft 16 to move it to the left through parts of the motion-transmitting connection previously described and which act on the stop ring 55. During this movement, the flexible ears of the conical spring disc 36 ratchet over the ratchet teeth 50.

In the event that there is a jam which prevents movement of the output shaft 16 and movement is imparted to the input shaft 11 in either linear direction, the input shaft is free to move. If the input shaft 11 moves to the right, as viewed in FIG. 2, the flexible ears of the conical spring disc 36 will be released and the conical spring disc 36 as well as the circular block 61 can move to the right as permitted by compression of the compression coil spring 60. If the input shaft 11 is moved toward the left, the flexible ears of the conical spring disc 38 are released from the wall 31 of the bore and the conical spring 38 and circular block 62 move to the left as permitted by further compression of the compression coil spring 60.

The freedom of movement for the input shaft 11 enables use of two linear no-back devices in parallel as operated by a single input member 10. If one output shaft 16 jams, it is still possible to operate the other output shaft through the other linear no-back device because the input shaft of the linear no-back device having the jammed output shaft is still movable and this permits the input member 10 to move to operate the second linear no-back device.

It will be evident that preloaded compression coil spring 60 is of a strength to resist further compression in normal transmittal of motion from the input shaft 11 to the output shaft 16 and will only compress when the output shaft 16 is blocked and the output shaft 11 is moved. Also, flexibility of the flexible ears of the conical spring discs can be varied by dimensioning thereof. For example, the length of the ears can be made proportional to the applied force wherein a large applied force will have shorter, less flexible ears, than are required for a small applied force. It will be obvious that the fixed member 30 can be of whatever length required to accommodate the maximum linear stroke of the input shaft 11 in either direction.

We claim:

1. A linear no-back device for transmitting bi-directional linear motion from an input shaft to a coaxial output shaft while preventing motion of the output shaft independently of the input shaft comprising, releasable means locking the output shaft against movement, means movable with the input shaft for acting on the releasable means for release thereof to enable movement of the output shaft with the input shaft, and motion-transmitting means between the input and output shafts including a preloaded compression coil spring which absorbs the motion of the input shaft if the output shaft is unable to move.

2. A linear no-back device as defined in claim 1 wherein said releasable means comprises a pair of conical discs with a plurality of flexible ears at the periphery thereof.

3. A linear no-back device as defined in claim 2 wherein said means movable with the input shaft includes an actuator member engageable with the flexible ears of a conical disc to flex said ears to an unlocking position.

4. A linear no-back device for transmitting bi-directional linear motion from an input shaft to an output shaft while preventing motion of the output shaft independently of the input shaft comprising, a fixed member having a bore, a pair of oppositely-acting spring discs loosely mounted on the output shaft and having peripheral flexible means in engagement with a wall of said bore, a pair of spaced-apart stop means on the output shaft for limiting separating movement of said spring discs axially of the output shaft, means urging said spring discs away from each other including a pair of members engageable one with each of said spring discs and a preloaded compression coil spring therebetween, and means movable with the input shaft for effectively disengaging said spring discs from said wall and acting on one of said members to transmit motion to the output shaft through said compression coil spring, the other of said members and one of said stop means.

5. A linear no-back device for transmitting bi-directional linear motion from an input shaft to an output shaft while preventing motion of the output shaft independently of the input shaft comprising, a fixed member having a bore, a pair of conical spring discs loosely mounted on the output shaft and having flexible ears in engagement with a wall of said bore, the ears engaging said wall at an angle whereby movement of a spring disc in one direction is prevented and movement in the other direction is permitted, a pair of spaced-apart stop means on the output shaft for limiting separating movement of said spring discs axially of the output shaft, means urging said spring discs away from each other including a pair of members engageable one with each of said spring discs and a preloaded compression coil spring therebetween, and an actuator member movable with the input shaft for flexing the ears of one spring disc away from said wall and acting on one of said members to transmit motion to the output shaft through said compression coil spring, the other of said members and one of said stop means with the ears of the other of said spring discs sliding along the wall of said bore.

6. A linear no-back device comprising, a fixed member having an internal opening with a wall, an output shaft with a part thereof positioned in said opening and having a pair of spaced-apart stop rings thereon, a pair of generally conical spring discs loosely mounted on said part of the output shaft and each having a plurality of ears engageable with said wall, said spring discs having concave inner faces facing each other and outer faces, a pair of blocks loosely mounted on said output shaft part and each having a conical face to engage an inner face of a spring disc radially inwardly of said ears, a preloaded compression coil spring surrounding said output shaft part and positioned between said blocks for engagement therewith to urge the spring discs against said stop rings, an input shaft, a pair of actuator members positioned to engage the outer faces of said spring discs and said ears whereby movement of an actuator member toward the adjacent spring disc will disengage the ears of the last-mentioned spring disc from said wall followed by movement of the spring disc and adjacent block, and means connecting said actuator members to said input shaft for movement therewith.

7. A linear no-back device comprising, a fixed member having a cylindrical bore with a wall having oppositely-facing ratchet teeth adjacent opposite ends thereof, an output shaft with a part thereof positioned in said bore and having a pair of spaced-apart stop rings thereon, a pair of oppositely-acting generally conical spring discs loosely mounted on said part of the output shaft and each having a plurality of ears engageable in said ratchet teeth, said spring discs having inner faces facing each other and outer faces, a pair of circular blocks loosely mounted on said output shaft part and each having a conical face to engage an inner face of a spring disc radially inwardly of said ears, a preloaded compression coil spring surrounding said output shaft part and positioned between said blocks for engagement therewith to urge the spring discs against said stop rings, an input shaft, a pair of actuator rings positioned to engage the outer faces of said spring discs and said ears whereby movement of an actuator ring toward the adjacent spring disc will release the ears of the last-mentioned spring disc from said ratchet teeth followed by movement of the spring disc and adjacent circular block, and means connecting said actuator rings to said input shaft for movement therewith.

8. A linear no-back device for transmitting bi-directional linear motion from an input shaft to an output shaft while preventing motion of the output shaft independently of the input shaft comprising, a fixed member with a bore, releasable means including a pair of conical spring discs operable one in each direction to lock the output shaft against movement, means including a pair of actuator rings movable with the input shaft with one acting on one conical disc in one direction of linear movement for release thereof and the other acting on the other conical disc in the opposite direction of linear movement to enable movement of the output shaft with the input shaft, and motion-transmitting means between the input and output shafts including a spring which absorbs the motion of the input shaft if the output shaft is unable to move.

* * * * *